US008375718B2

(12) United States Patent
Shin et al.

(10) Patent No.: US 8,375,718 B2
(45) Date of Patent: Feb. 19, 2013

(54) APPARATUS FOR GENERATING ENERGY USING A SENSIBLE HEAT DURING MANUFACTURING OF MOLTEN IRON AND METHOD FOR GENERATING ENERGY USING THE SAME

(75) Inventors: Myoung-Kyun Shin, Pohang-shi (KR); Sang-Hyun Kim, Pohang-shi (KR); Min-Chul Park, Pohang-shi (KR); Sang-Hoon Joo, Pohang-shi (KR); Robert Millner, Linz (AT)

(73) Assignees: Posco, Pohang-Shi (KR); Siemens Vai Metals Technologies GmbH & Co., Linz (AT)

( * ) Notice: Subject to any disclaimer, the term of this patent is extended or adjusted under 35 U.S.C. 154(b) by 904 days.

(21) Appl. No.: 12/519,739

(22) PCT Filed: Dec. 17, 2007

(86) PCT No.: PCT/KR2007/006605

§ 371 (c)(1),
(2), (4) Date: Jun. 17, 2009

(87) PCT Pub. No.: WO2008/075870

PCT Pub. Date: Jun. 26, 2008

(65) Prior Publication Data

US 2009/0308074 A1 Dec. 17, 2009

(30) Foreign Application Priority Data

Dec. 18, 2006 (KR) ..... 10-2006-0129410

(51) Int. Cl.
*F01K 13/00* (2006.01)

(52) U.S. Cl. ..... 60/645; 60/670

(58) Field of Classification Search ..... 60/645, 60/670, 683, 684
See application file for complete search history.

(56) References Cited

U.S. PATENT DOCUMENTS 4,673,432 A 6/1987 Hauk (Continued)

FOREIGN PATENT DOCUMENTS

CN 1434132 8/2003
JP 04-191307 7/1992

(Continued)

OTHER PUBLICATIONS

Weston, T R. The Romelt process—applications in the 21st century steel industry, Oxygen-Coal Iron-Steel Making—International Conference Proceedings; Beijing; China; Jun. 23-26, 1997. pp. 213-224.

(Continued)

*Primary Examiner* — Thomas Denion
*Assistant Examiner* — Jonathan Matthias
(74) *Attorney, Agent, or Firm* — Lexyoume IP Meister, PLLC.

(57) ABSTRACT

An apparatus for generating energy using sensible heat of an offgas during manufacture of molten iron and a method for generating energy using the same are provided. The method for generating energy includes i) providing an offgas discharged from an apparatus for manufacturing molten iron including a reduction reactor that provides reduced iron that is reduced from iron ore and a melter-gasifier that melts the reduced iron to manufacture molten iron; ii) converting cooling water into high pressure steam by contacting the cooling water with the offgas; and iii) generating energy from at least one steam turbine by supplying the high pressure steam to the steam turbine and rotating the steam turbine.

14 Claims, 5 Drawing Sheets

U.S. PATENT DOCUMENTS

| | | | | |
|---|---|---|---|---|
| 5,643,354 | A * | 7/1997 | Agrawal et al. | 75/490 |
| 2008/0022683 | A1* | 1/2008 | Ohler et al. | 60/641.8 |
| 2008/0115495 | A1* | 5/2008 | Rising | 60/731 |

FOREIGN PATENT DOCUMENTS

| | | |
|---|---|---|
| JP | 08-199215 | 8/1996 |
| JP | 10-152710 | 6/1998 |
| JP | 11-315314 | 11/1999 |
| JP | 2001-515144 | 9/2001 |
| JP | 2002-146420 | 5/2002 |
| JP | 2006-511707 | 4/2006 |
| KR | 20 1990 0010261 U | 3/1999 |
| KR | 10 2002 0083638 A | 11/2002 |
| KR | 10 2005 0054849 A | 6/2005 |
| WO | 89/01981 | 3/1989 |

OTHER PUBLICATIONS

Lemperle et al., Corex Today and Tomorrow, Wisco Technology, 1995, No. 6, vol. 33, pp. 17-22.

French Energy-Saving Technology, Energy-Saving and Environmental Protection, 1986, No. 4, Intelligence Department of Beijing Energy Conservation Technology Service Center, pp. 31-34.

* cited by examiner

APPARATUS FOR GENERATING ENERGY USING A SENSIBLE HEAT DURING MANUFACTURING OF MOLTEN IRON AND METHOD FOR GENERATING ENERGY USING THE SAME

CROSS REFERENCE TO RELATED APPLICATIONS

This application is a national phase application based on international application number PCT/KR2007/006605, filed Dec. 17, 2007, and claims priority of Korean Patent Application No. 10-2006-0129410, filed Dec. 18, 2006, the content of both of which is incorporated herein by reference.

TECHNICAL FIELD

The present invention relates to an apparatus for generating energy and a method for generating energy using the same, and more specifically to an apparatus for generating energy using a sensible heat of an offgas during manufacture of molten iron and a method for generating energy using the same.

BACKGROUND ART

Recently, a smelting reduction process, which can replace the blast furnace method, has been researched. In the smelting reduction process, raw coal is directly used as a fuel and a reducing agent and iron ore is directly used as an iron source, and thereby iron ore is reduced in a reduction reactor and molten iron is manufactured in a melter-gasifier.

Oxygen is injected into the melter-gasifier and then burns a coal-packed bed therein. The oxygen is converted into a reducing gas and is discharged from the melter-gasifier. The reducing gas discharged from the melter-gasifier is transferred to a reduction reactor. Iron ore is reduced by the reducing gas in the reduction reactor. The reducing gas is discharged from the reduction reactor as an offgas after reducing the iron ore.

Dust contained in the offgas is collected by spraying water, and the offgas is partly reformed and is then used as a reducing gas again. Since the temperature of the offgas is high, the offgas has much sensible heat that is lost during circulation thereof.

DISCLOSURE

Technical Problem

An apparatus for generating energy and that is capable of recycling energy by using sensible heat of an offgas during manufacture of molten iron is provided. In addition, a method for generating energy that is capable of recycling energy by using a sensible heat of an offgas during manufacture of molten iron is provided.

Technical Solution

A method for generating energy according to an embodiment of the present invention includes i) providing an offgas discharged from an apparatus for manufacturing molten iron including a reduction reactor that provides reduced iron that is reduced from iron ore and a melter-gasifier that melts the reduced iron to manufacture molten iron; ii) converting cooling water into high pressure steam by contacting the cooling water with the offgas; and iii) generating energy from at least one steam turbine by supplying the high pressure steam to the steam turbine and rotating the steam turbine.

The offgas may be discharged after reducing the iron ore in the reduction reactor, wherein the reduction reactor is a packed-bed reduction reactor or a fluidized-bed reduction reactor in the providing of the offgas. The offgas may be discharged from the melter-gasifier in the providing of the offgas. The apparatus for manufacturing molten iron may further include a reduced iron supply bin that supplies the reduced iron that is reduced in the reduction reactor to the melter-gasifier. The reduced iron supply bin may be connected to the reduction reactor and the melter-gasifier. The offgas may be discharged from the reduced iron supply bin in the providing of the offgas.

The temperature of the offgas after the offgas contacts the cooling water may be in a range from 200° C. to 250° C. in the converting of the cooling water into high pressure steam. The cooling water may indirectly contact the offgas in the converting of the cooling water into high pressure steam. The pressure of the high pressure steam supplied to the steam turbine may be equal to or greater than 40 bar.g in the generating of energy.

A method for generating energy according to an embodiment of the present invention may further include i) providing low pressure steam that is discharged from the steam turbine that is rotated by the high pressure steam; ii) providing the cooling water by cooling the low pressure steam; and iii) supplying the cooling water to the offgas. An energy generated in the generating of the energy may be used in the supplying of the cooling water to the offgas.

A method for generating energy according to an embodiment of the present invention may further include i) supplying processing water to the offgas that is contacted with the cooling water; ii) collecting dust from the offgas by spraying water by using the processing water; and iii) withdrawing the processing water that has finished collecting dust by spraying water. Energy generated in the generating of the energy may be used in the supplying of the processing water to the offgas.

A method for generating energy according to an embodiment of the present invention may further include compressing the offgas which contacted with the cooling water. An energy generated in the generating energy may be used in the compressing the offgas.

A method for generating energy according to an embodiment of the present invention may further include i) providing low pressure steam that is discharged from the steam turbine that is rotated by the high pressure steam; ii) providing the cooling water by cooling the low pressure steam; iii) branching the cooling water; iv) heating the branched cooling water to convert it into surplus high pressure steam; and v) supplying the surplus high pressure steam to the steam turbine. A method for generating energy according to an embodiment of the present invention may further include storing the high pressure steam. The at least one steam turbine may include a plurality of steam turbines to be connected to each other in a parallel manner in the generating of the energy.

An apparatus for generating energy according to an embodiment of the present invention includes i) a cooling water storage bin that supplies cooling water; ii) a steam generator that converts the cooling water into high pressure steam by contacting the cooling water with offgas discharged from an apparatus for manufacturing molten iron including a reduction reactor that provides reduced iron that is reduced from iron ore and a melter-gasifier that melts the reduced iron to manufacture molten iron; and iii) at least one steam turbine that is connected to the steam generator, the steam turbine generating energy by being rotated by the high pressure steam supplied from the steam generator.

The steam generator may include a plurality of pipes through which the cooling water passes, and the offgas may contact an outer surface of the plurality of pipes. The offgas may be discharged after reducing the iron ore in the reduction reactor. The apparatus for manufacturing molten iron may further include an offgas line through which the offgas passes. The offgas line may be connected to the reduction reactor. The reduction reactor may be a fluidized-bed reduction reactor or a packed-bed reduction reactor. The steam generator may be connected to the offgas line.

The apparatus for manufacturing molten iron may further include a gas compressor installed in an offgas supply line branched from the offgas line, and the steam turbine may be connected to the gas compressor to supply power to the gas compressor. The offgas may be discharged from the melter-gasifier, and the apparatus for manufacturing molten iron may further include a reducing gas supply line through which the offgas flows. The reducing gas supply line may be connected to the melter-gasifier. The steam generator may be connected to the reducing gas supply line.

The apparatus for manufacturing molten iron may further include i) a reduced iron supply bin that connects the reduction reactor to the melter-gasifier and supplies reduced iron that is reduced in the reduction reactor to the melter-gasifier; and ii) an offgas discharging line that discharges the offgas from the reduced iron supply bin. The steam generator may be connected to the offgas discharging line. The temperature of the offgas after contacting the cooling water may be in a range from 220° C. to 250° C. The pressure of the high pressure steam supplied to the steam turbine may be equal to or greater than 40 bar.g.

The apparatus for generating energy according to an embodiment of the present invention may further include i) a condenser that cools low pressure steam that is discharged from the steam turbine to convert the low pressure steam into cooling water; and ii) a cooling water circulation pump that is connected to the condenser and supplies the cooling water to the steam generator. The steam turbine may be connected to the cooling water circulation pump to delivery power to the cooling water circulation pump.

The apparatus for manufacturing molten iron may further include i) a scrubber that collects dust contained in the offgas by spraying water; ii) a processing water storage bin that is connected to the scrubber to supply processing water to the scrubber and withdraw processing water that has finished collecting dust by spraying water; and iii) a processing water circulation pump that is connected to the processing water storage bin and the scrubber, the processing water circulation pump circulating the processing water between the processing water storage bin and the scrubber. The steam turbine may be connected to the processing water circulation pump to delivery power to the processing water circulation pump.

The apparatus for generating energy according to an embodiment of the present invention may further include a surplus steam generator that heats cooling water branched from the cooling water supplied to the steam generator to convert it into surplus high pressure steam and supplies the surplus high pressure steam to the steam turbine. The apparatus for generating energy according to an embodiment of the present invention may further include a steam storage bin that connects the steam generator to the steam turbine and stores high pressure steam generated from the steam generator. The at least one steam turbine may include a plurality of steam turbines connected to each other in a parallel manner.

Advantageous Effects

Energy utilization efficiency can be improved by generating energy using sensible heat of the offgas during manufacture of molten iron. In addition, reducing power of the reducing gas can be raised by lowering the temperature of the reducing gas using cooled offgas during manufacture of molten iron.

BEST MODE

Figure 1:
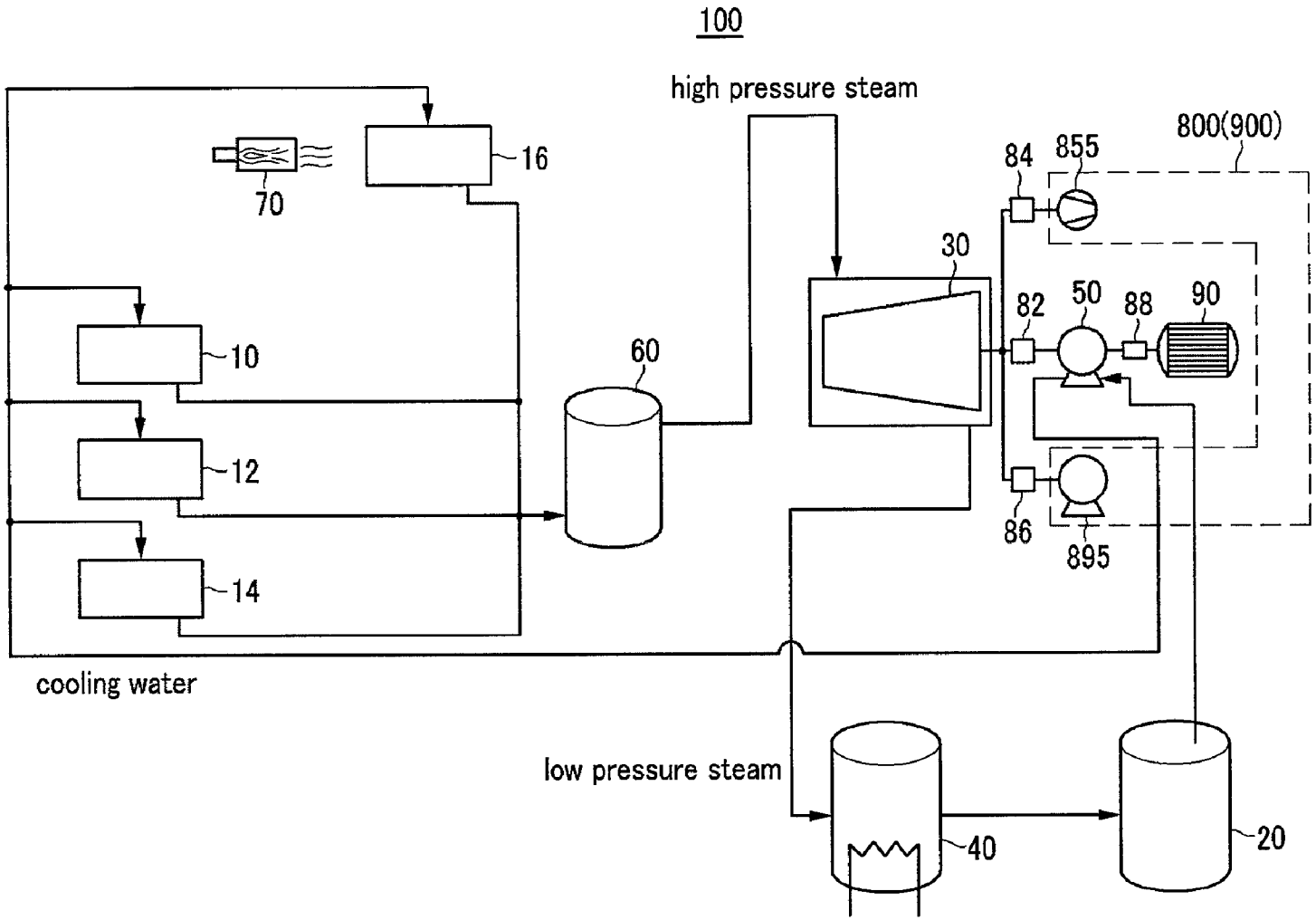
FIG. 1 is schematic view of an apparatus for generating energy according to a first embodiment of the present invention.

Exemplary embodiments of the present invention will be explained in detail below with reference to the attached drawings in order for those skilled in the art in the field of the present invention to easily perform the present invention. However, the present invention can be realized in various forms and is not limited to the embodiments explained below. In addition, like reference numerals refer to like elements in the present specification and drawings.

All terms including technical and scientific terms used herein have the same meaning as commonly understood by one of ordinary skill in the art to which this invention belongs. It will be further understood that terms such as those defined in commonly used dictionaries should be interpreted as having a meaning that is consistent with their meaning in the context of the relevant art and the present disclosure, and will not be interpreted in an idealized or overly formal sense unless expressly so defined herein.

FIG. 1 schematically shows an apparatus for generating energy 100 according to a first embodiment of the present invention. An area surrounded by a dotted line in FIG. 1 illustrates apparatuses for manufacturing molten iron 800 and 900 (shown in FIGS. 3 and 4) connected to the apparatus for generating energy 100.

As illustrated in FIG. 1, the apparatus for generating energy 100 includes steam generators 10, 12, and 14, a cooling water storage bin 20, and a steam turbine 30. In addition, the apparatus for generating energy 100 further includes a condenser 40, a cooling water circulation pump 50, a steam storage bin 60, a burner 70, and power transmissions 82, 84, and 86.

FIG. 1 schematically shows an apparatus for generating energy 100 according to a first embodiment of the present invention. The structure of the apparatus for generating energy 100 of FIG. 1 is merely to illustrate the present invention and the present invention is not limited thereto. Therefore, the structure of the apparatus for generating energy 100 can be changed into other forms.

As shown in FIG. 1, the apparatus for generating energy 100 includes steam generators 10, 12, and 14, a cooling water storage bin 20, and a steam turbine 30. In addition, the apparatus for generating energy 100 further includes a condenser 40, a cooling water circulation pump 50, a steam storage bin 60, a burner 70, and power transmissions 82, 84, and 86.

As shown in FIG. 1, the steam generators 10, 12 and 14 include first, second and third steam generators 10, 12, and 14. The steam generators 10, 12, and 14 heat-exchange cooling water with offgases discharged from the apparatuses for manufacturing molten iron 800 and 900 (shown in FIGS. 3 and 4). Therefore, the cooling water is converted into high pressure steam by sensible heat of hot offgas. Internal structures of the steam generators 10, 12, and 14 will be explained in detail below with reference to FIG. 2.

As shown in FIG. 1, the above-described high pressure steam is stored in the steam storage bin 60 connected to the steam generators 10, 12, and 14. The steam storage bin 60 connects the steam generators 10, 12, and 14 to the steam turbine 30. Although the steam storage bin 60 is drawn in FIG. 1, it can be omitted.

The high pressure steam discharged from the steam storage bin 60 is supplied to the steam turbine 30. Pressure of the high pressure steam supplied to the steam turbine 30 is equal to or greater than 40 bar.g. Therefore, the steam turbine 30 can be operated with a desired speed by the high pressure steam and operating efficiency of the steam turbine 30 can be optimized.

The steam turbine 30 rotates to generate energy by the high pressure steam supplied thereto. The high pressure steam supplied to the steam turbine 30 rotates the steam turbine 30 while expanding, cooling, and being discharged outside as low pressure steam. It is possible to compress gas, operate a pump, and generate electricity by a rotating power of the steam turbine 30. This will be explained in detail as follows.

Firstly, as shown in FIG. 1, the steam turbine 30 is connected to the cooling water circulation pump 50 through the power transmission 82. Therefore, the steam turbine 30 transfers power to the cooling water circulation pump 50. That is, the cooling water circulation pump 50 rotates together with the rotating steam turbine 30 to circulate the cooling water. The power transmission 82 is also referred to as a coupling. Since the power transmission 82 can include reduction gears etc., the cooling water circulation pump 50 can rotate with a rotating speed that is lower than that of the steam turbine 30. Since connecting structures of the steam turbine 30, the power transmission 82, and the cooling water circulation pump 50 can be easily understood by those skilled in the art, a detailed description thereof is omitted.

As shown in FIG. 1, the cooling water circulation pump 50 receives the cooling water supplied from the cooling water storage bin 20 and transfers it to the steam generators 10, 12, and 14. Therefore, energy generated from the steam turbine 30 is used in the cooling water circulation pump 50 supplying the cooling water to the offgas, and thereby the high pressure steam can be continuously produced in the steam generators 10, 12, and 14.

Meanwhile, the cooling water circulation pump 50 is connected to another axis that is different from an axis to which the power transmission 82 is connected. The cooling water circulation pump 50 and an electric motor 90 are connected to each other through the power transmission 88. Therefore, the electric motor 90 is driven to rotate by separate electricity even when the steam turbine 30 does not operate, thereby being capable of operating the cooling water circulation pump 50. For example, the cooling water circulation pump 50 can be operated by the electric motor 90 before the steam turbine 30 is driven. As a result, the cooling water can be continuously circulated.

Secondly, as shown in FIG. 1, the steam turbine 30 operates a gas compressor 855 by the power transmission 84. Since the power transmission 84 includes reduction gears etc., a rotating speed of the gas compressor 855 can be controlled well. Since connecting structures of the steam turbine 30, the power transmission 84 and the gas compressor 855 can be easily understood by those skilled in the art, a detailed description thereof is omitted. The gas compressor 855 compresses gas that has entered by a rotating power into gas with a high pressure. Therefore, the gas can be discharged outside after its pressure is raised. In this case, the high pressure gas is supplied to gas reformers 880 (shown in FIGS. 3 and 4), thereby maximizing reforming efficiency of the gas.

Figure 3:
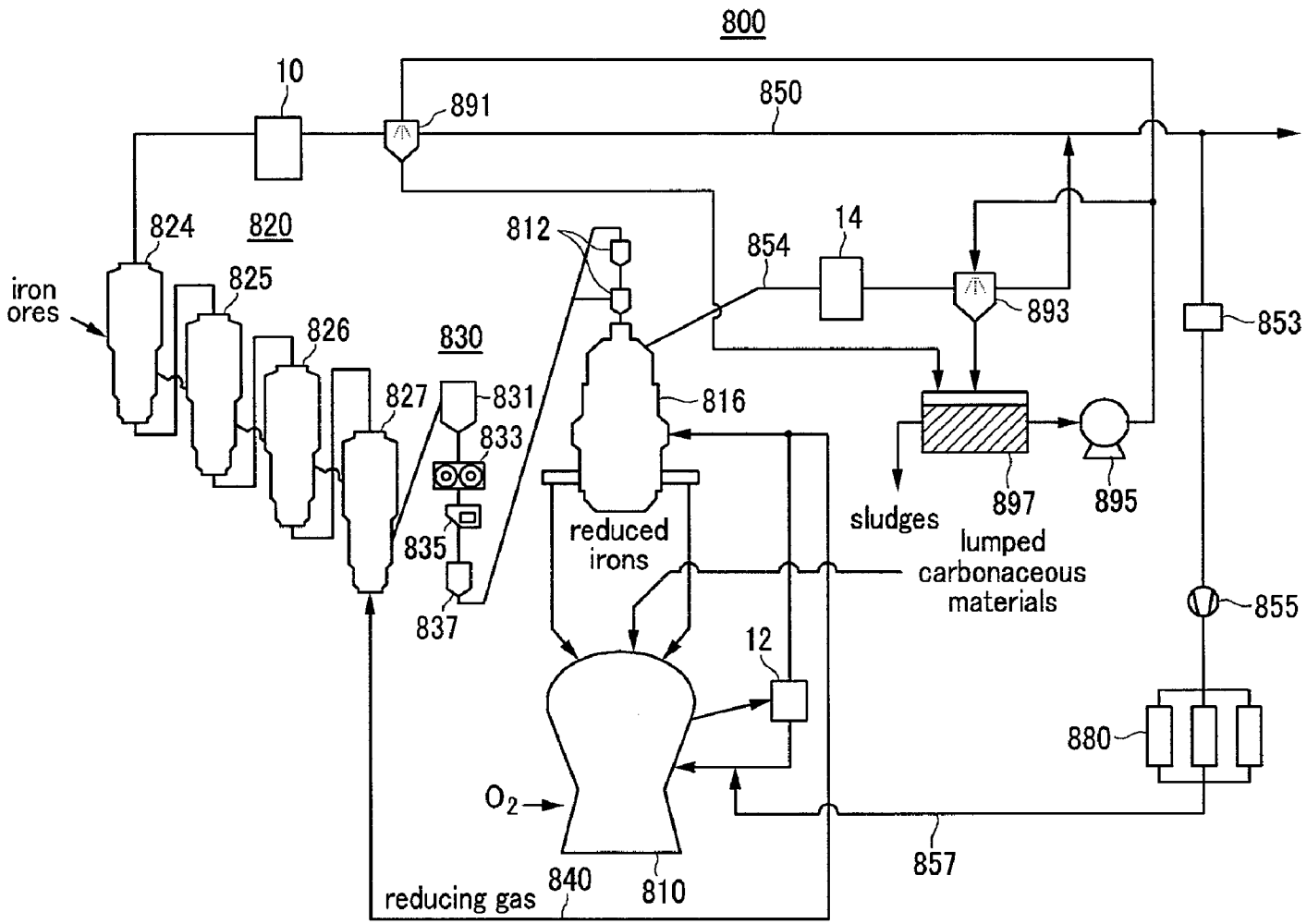
FIG. 3 is a schematic view of an apparatus for manufacturing molten iron connected to the apparatus for generating energy of FIG. 1.
Figure 4:
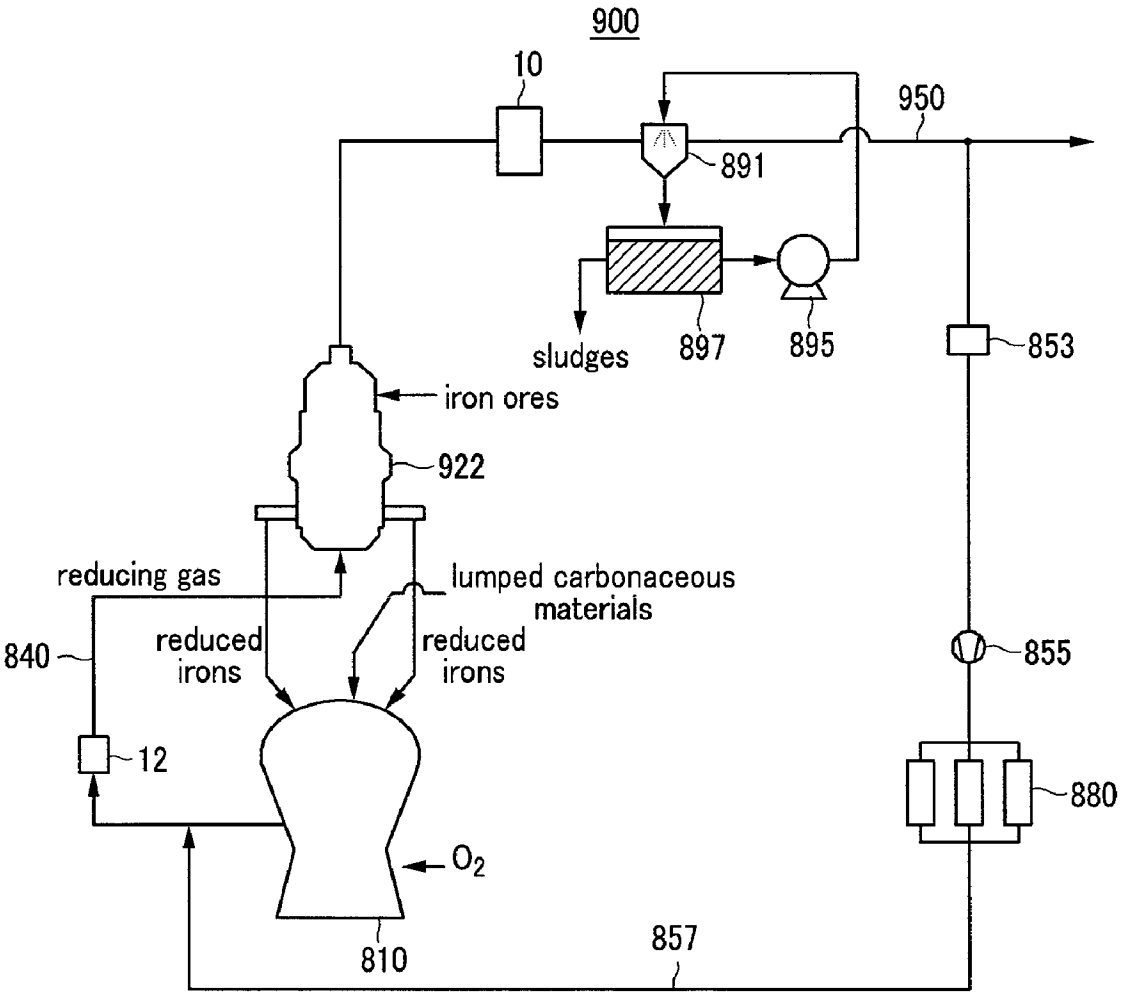
FIG. 4 is a schematic view of another apparatus for manufacturing molten iron connected to the apparatus for generating energy of FIG. 1.

Thirdly, as shown in FIG. 1, the steam turbine 30 can transfer power to a processing water circulation pump 895 (shown in FIGS. 3 and 4). The steam turbine 30 is connected to the processing water circulation pump 895 by the power transmission 86. Since the processing water circulation pump 895 includes reduction gears etc., the processing water circulation pump 895 can be rotated with a desired rotating speed. Since connecting structures of the steam turbine 30, the power transmission 86, and the processing water circulation pump 895 can be easily understood by those skilled in the art, a detailed description thereof is omitted. Here, the processing water circulation pump 895 circulates the processing water, thereby collecting dust contained in the offgas discharged from the apparatuses for manufacturing molten iron 800 and 900 by spraying water. As a result, the processing water circulation pump 895 included in the apparatuses for manufacturing molten iron 800 and 900 can be operated by the steam turbine 30, and thereby energy can be re-circulated.

As shown in FIG. 1, low pressure steam discharged from the steam turbine 30 is cooled in the condenser 40 to be converted into cooling water. Other cooling water flows through a plurality of tubes in the condenser 40 and the low pressure steam contacts outer surfaces of the plurality of tubes. Therefore, heat is taken from the low pressure steam to be converted into the cooling water. After the cooling water is stored in the cooling water storage bin 20, it is supplied to the cooling water circulation pump 50, thereby circulating in the apparatus for generating energy 100.

Meanwhile, if an amount of the high pressure steam is deficient, it can be increased by manufacturing the high pressure steam as needed. That is, as shown in FIG. 1, the cooling water branched from the cooling water supplied to the steam generators 10, 12, and 14 is supplied to the surplus steam generator 16. Oxygen and fuel are supplied to the burner 70, thereby heating the surplus steam generator 16 with hot combustion gas. Therefore, the cooling water passing through the surplus steam generator 16 is heated to be converted into the high pressure steam. After the surplus high pressure steam generated from the surplus steam generator 16 is stored in the steam storage bin 60, it is supplied to the steam turbine 30. Therefore, if an amount of the high pressure steam is deficient, it can be easily increased. An internal structure of the first steam generator 10 of FIG. 1 will be explained in detail with reference to FIG. 2.

Figure 2:
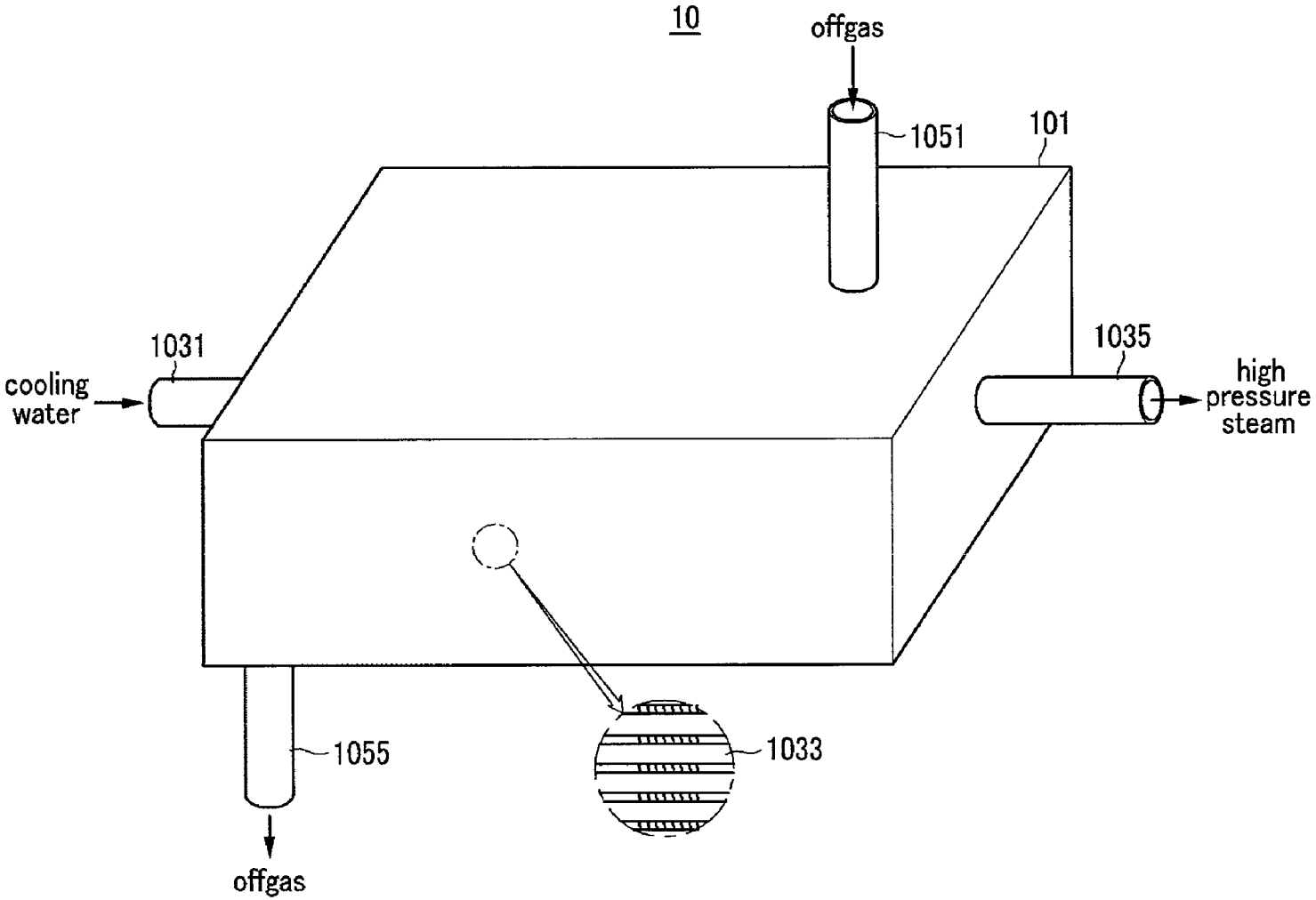
FIG. 2 is a schematic perspective view of an inner structure of the steam generator of FIG. 1.

FIG. 2 schematically illustrates the first steam generator 10 of FIG. 1. An internal structure thereof is magnified to be shown in an enlarged circle of FIG. 2. The structure of the first steam generator 10 can be identically adapted to those of the second and third steam generators 12 and 14 (shown in FIG. 1). In addition, the structure of the first steam generator 10 of FIG. 2 is merely to illustrate the present invention and the present invention is not limited thereto. Therefore, the structure of the first steam generator 10 can be modified in other forms.

As shown in FIG. 2, the first steam generator 10 includes a casing 101 and a plurality of pipes 1033. After the cooling water enters into an inlet pipe 1031, it passes through the plurality of pipes 1033 while being branched thereinto. As shown in the enlarged circle of FIG. 2, the cooling water flows through the plurality of pipes 1033 while being heated by the offgas, thereby being converted into high pressure steam. The high pressure steam is discharged outside through an outlet pipe 1035 to which the plurality of pipes 1033 are joined.

The offgas contacts with outer surfaces of the plurality of pipes 1033, thereby transferring its sensible heat to the plurality of pipes 1033. That is, the offgas indirectly contacts the cooling water. If the offgas and the cooling water directly contact with each other, dust in the offgas is contained in the cooling water even though heat exchange can be better performed. Therefore, cooling efficiency of the cooling water is deteriorated. Since the first steam generator 10 includes the plurality of pipes 1033, a contact area between the offgas and the plurality of pipes 1033 is maximized. Therefore, the sensible heat of the offgas can be efficiently transferred to the cooling water passing through the plurality of pipes 1033.

Meanwhile, the offgas enters into the first steam generator 10 through the offgas inlet 1051. The offgas is cooled in the first steam generator 10 while heating a plurality of pipes 1033. The cooled offgas is discharged outside through the offgas outlet 1055.

As shown in FIG. 2, the in/out directions of the offgas are opposite to those of the cooling water in the first steam generator 10. That is, the first steam generator 10 is a counterflow type. However, the steam generator 10 can be designed to be a concurrent type, that is, a type in which the in/out directions of the offgas are the same as those of the cooling water.

FIG. 3 schematically shows an apparatus for manufacturing molten iron 800 connected to the apparatus for generating energy 100 of FIG. 1.

As shown in FIG. 3, the apparatus for manufacturing molten iron 800 includes a fluidized-bed reduction reactor 820, an apparatus for manufacturing compacted iron 830, a melter-gasifier 810, and a reducing gas supply line 840. In addition, the apparatus for manufacturing molten iron 800 further includes a hot pressure equalizing device 812 and a fine reduced iron storage bin 816. The apparatus for manufacturing molten iron 800 can include other devices if necessary.

As shown in FIG. 3, the fluidized-bed reduction reactor 820 includes first, second, third, and fourth fluidized-bed reduction reactors 824, 825, 826, and 827. The first, second, third, and fourth fluidized-bed reduction reactors 824, 825, 826, and 827 are continuously connected to each other. A reducing gas from the melter-gasifier 810 is supplied to the fluidized-bed reduction reactor 820 through a reducing gas supply line 840, and thereby the fluidized-bed reduction reactor 820 reduces iron ore to provide reduced iron. The first fluidized-bed reduction reactor 824 preheats supplied iron ore by the reducing gas. The second and third fluidized-bed reduction reactors 825 and 826 pre-reduce the preheated iron ore. In addition, the fourth fluidized-bed reduction reactor 827 finally reduces pre-reduced iron ore to manufacture fine iron ore.

The fluidized-bed reduction reactor 820 transfers fine reduced iron to an apparatus for manufacturing compacted iron 830. The apparatus for manufacturing compacted iron 830 compacts the fine reduced iron. If the fine reduced iron is directly charged into the melter-gasifier 810, the fine reduced iron is scattered outside by a reducing gas in the melter-gasifier 810. In addition, if the fine reduced iron is directly charged into the melter-gasifier 810, permeability of an inner space of the melter-gasifier 820 can be deteriorated. Therefore, after the fine reduced iron is manufactured into compacted iron by the apparatus for manufacturing compacted iron 830, it is supplied to the melter-gasifier 810.

As shown in FIG. 3, the apparatus for manufacturing compacted iron 830 includes a storage bin 831, a pair of rollers 833, a crusher 835, and a compacted iron storage bin 837. The storage bin 831 temporarily stores the fine reduced iron. The fine reduced iron is discharged from the storage bin 831 to be manufactured into strip-type compacted iron by the pair of rollers 833. The crusher 835 crushes the compacted iron to be manufactured into a suitable size. The crushed compacted iron is stored in the compacted iron storage bin 837.

The hot pressure equalizing device 812 connects the apparatus for manufacturing compacted iron 830 to the reduced iron supply bin 816. The hot pressure equalizing device 812 controls a pressure between the apparatus for manufacturing compacted iron 830 and the reduced iron supply bin 816 to force-feed the compacted iron from the apparatus for manufacturing compacted iron 830 to the reduced iron supply bin 816. The reduced iron supply bin 816 stores the compacted iron and supplies it to the melter-gasifier 810.

The compacted iron is charged into the melter-gasifier 810 and melted therein. Lumped carbonaceous materials are charged into the melter-gasifier 810 and form a coal-packed bed therein. Here, the lumped carbonaceous materials can be, for example, lumped coal or coal briquettes. Oxygen is injected into the melter-gasifier 810, thereby burning the coal-packed bed and melting the compacted iron by combustion heat of the coal-packed bed. The compacted iron is melted to be manufactured into molten iron, and is discharged outside.

The reducing gas generated from the coal-packed bed is supplied to the fluidized-bed reduction reactor 820 and the reduced iron supply bin 816 through the reducing gas supply line 840. Therefore, the compacted iron supplied to the reduced iron supply bin 816 can be reduced again. Meanwhile, although not shown in FIG. 3, coarse iron ore, for example iron ore with a grain size equal to or greater than 8 mm, can be supplied to the reduced iron supply bin 816.

As shown in FIG. 3, the offgas ventilated from the first fluidized-bed reduction reactor 824 is discharged outside through the offgas line 850. The first steam generator 10 and the first scrubber 891 are installed in the offgas line 850. Although the first steam generator 10 and the first scrubber 891 are installed in the offgas line 850 and connected thereto, they may not be installed in the offgas line 850 itself but may merely be connected thereto.

The offgas is cooled while passing through the first steam generator 10 (refer to FIG. 1). That is, although the temperature of the offgas discharged from the first fluidized-bed reduction reactor 824 is in a range from 400° C. to 450° C., it changes to a range from 200° C. to 250° C. after contacting cooling water while passing through the first steam generator 10. If the temperature of the offgas is lower than 200° C., tar contained in the offgas is condensed into a solid state, thereby interrupting heat transfer of the offgas. In addition, if the temperature of the offgas is higher than 250° C., the offgas is mixed with the reducing gas and then the temperature of the reducing gas is raised too high, and thereby iron ore can be stuck to the inner side of the fluidized-bed reduction reactor 820. Therefore, the temperature of the offgas is controlled within the above-described range.

Next, as shown in FIG. 3, the offgas is cooled by the processing water that is sprayed from the first scrubber 891 again. The processing water that collects fine particles contained in the offgas and completes dust collection by spraying water is returned to the processing water storage bin 897. Fine particles contained in the processing water are discharged outside as sludge mixed with water from the processing water storage bin 897 and are removed. The processing water, from which the sludge is removed, is again supplied to the first scrubber 891 by the processing water circulation pump 895. The processing water circulation pump 895 is connected to the processing water storage bin 897 and the first scrubber 891, thereby circulating the processing water therebetween.

The offgas cooled by the first scrubber 891 is partly ventilated outside and the remainder of the offgas is mixed with the reducing gas discharged from the melter-gasifier 810 through the offgas supply line 857. A tar remover 853, a gas compressor 855, and a gas reformer 880 are installed in the offgas supply line 857 that is branched from the offgas line 850. The tar remover 853 removes tar contained in the offgas, and the gas compressor 855 raises the pressure of the offgas. The gas reformer 880 removes components that negatively influence reducing power of the reducing gas, such as carbon dioxide, from the offgas.

As shown in FIG. 3, the second steam generator 12 is installed in the reducing gas supply line 840 and is connected thereto. The second steam generator 12 converts the cooling water into the high pressure steam by using sensible heat of the offgas discharged from the melter-gasifier 810. Therefore, the temperature of the offgas flowing through the reducing gas supply line 840 can be lowered. The temperature of the reducing gas supplied to the fluidized-bed reduction reactor 820 is high, as it is in a range from about 900° C. to 950° C. However, the temperature of the offgas is lowered by the second steam generator 12, and thereby the temperature of the reducing gas changes to be in a range from 700° C. to 800° C.

Meanwhile, as shown in FIG. 3, offgas is discharged from the reduced iron supply bin 816 through an offgas discharging line 854. The third steam generator 14 is installed in the offgas discharging line 854 and is connected thereto. The offgas is cooled by the third steam generator 14 to have a temperature in a range from 500° C. to 600° C. The cooled offgas is purified by water by the second scrubber 893. Fine particles contained in the offgas are collected by the processing water that is sprayed from the second scrubber 893 and are then discharged outside as sludge from the processing water storage bin 897. The offgas processed by water purification is supplied to the offgas supply line 850, and is discharged outside or used as the reducing gas.

As described above, the processing water circulation pump 895 and the gas compressor 855 can be operated by the high pressure steam generated from the steam generators 10, 12, and 14 using sensible heat of the offgas. Therefore, use amount of energy of the apparatus for manufacturing molten iron 800 can be minimized.

FIG. 4 schematically shows another apparatus for manufacturing molten iron 900 connected to the apparatus for generating energy of FIG. 1. Since the structure of the apparatus for manufacturing molten iron 900 of FIG. 4 is similar to that of the apparatus for manufacturing molten iron 800 of FIG. 3, like elements are referred to with like reference numerals and detailed descriptions thereof are omitted.

As shown in FIG. 4, after reduced iron is manufactured by using a packed-bed reduction reactor 922, it is charged into the melter-gasifier 810, and is manufactured into molten iron. Lumped carbonaceous materials are charged into the melter-gasifier 810, a coal-packed bed is formed therein, and a reducing gas is discharged therefrom. The reducing gas is supplied to the packed-bed reduction reactor 922 through a reducing gas supply line 840, thereby converting the iron ore into reduced iron.

The offgas is discharged from the packed-bed reduction reactor 922 through an offgas line 950. The first steam generator 10 is installed in the offgas line 950. High-pressure steam is generated from the first steam generator 10 by withdrawing sensible heat of the offgas. In addition, high pressure steam can be generated in the second steam generator 12 using sensible heat of the offgas discharged from the melter-gasifier 810. Therefore, another apparatus for manufacturing molten iron 900 is connected to the apparatus for generating energy 100 of FIG. 1, thereby reducing use amount of energy.

Figure 5:
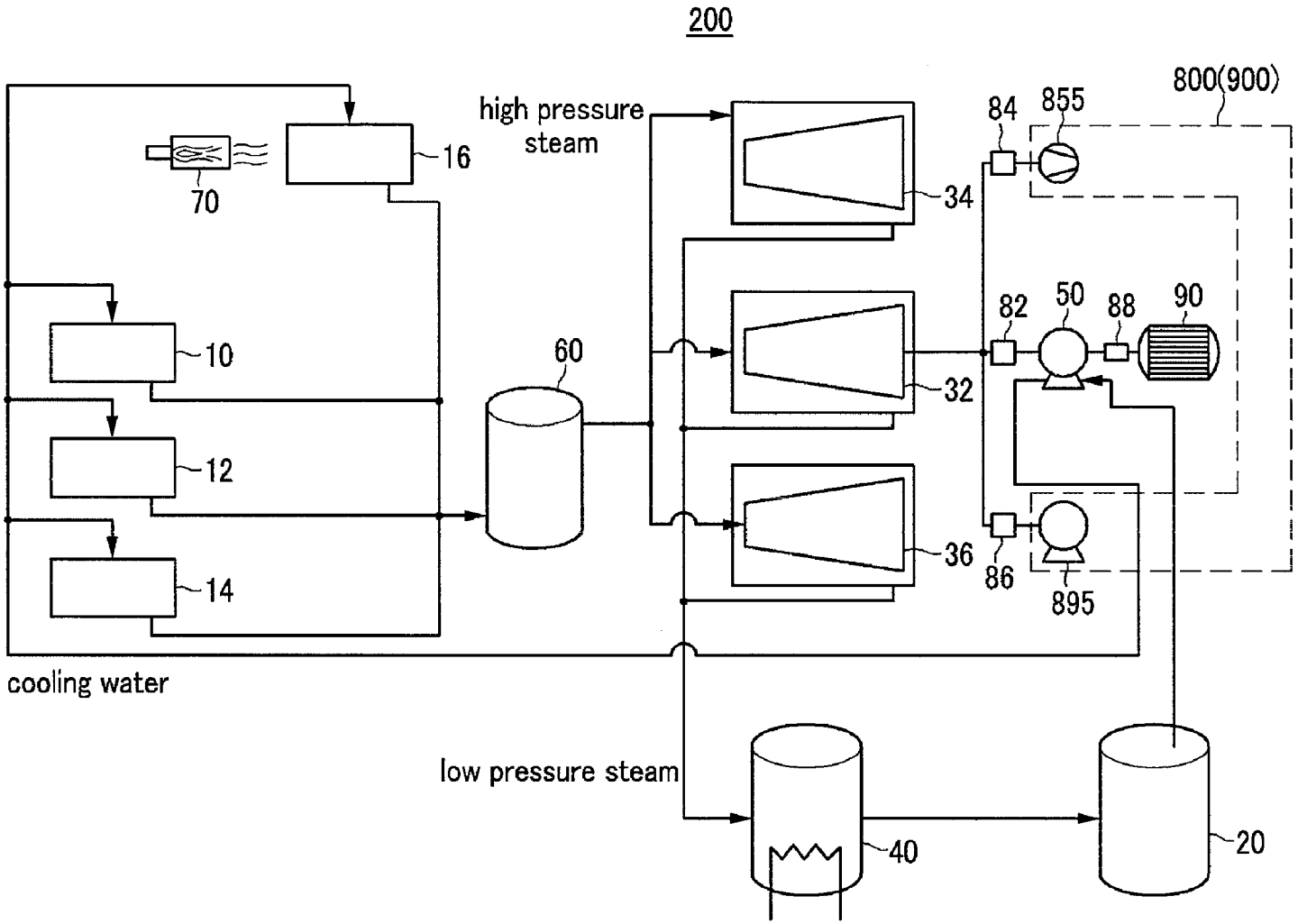
FIG. 5 is a schematic view of an apparatus for generating energy according to a second embodiment of the present invention.

FIG. 5 schematically shows an apparatus for generating energy 200 according to a second embodiment of the present invention. Since a structure of the apparatus for generating energy 200 of FIG. 5 is the same as that of the apparatus for generating energy 100 of FIG. 1, like reference numerals refer to like elements and detailed descriptions thereof are omitted. In addition, the apparatus for generating energy 200 of FIG. 5 can be used to be connected to the apparatuses for manufacturing molten iron 100 and 200 of FIGS. 3 and 4, respectively.

As shown in FIG. 5, the apparatus for generating energy 200 includes a plurality of steam turbines 32, 34, and 36 connected to each other in a parallel manner. Here, the plurality of steam turbines 32, 34, and 36 include first, second, and third steam turbines 32, 34, and 36. Therefore, the steam turbines 32, 34, and 36 are small, thereby maximizing energy generation.

The present invention will be explained in detail with reference to the Exemplary Example below. The Exemplary Example is merely to illustrate the present invention and the present invention is not limited thereto.

Exemplary Example

Sensible heat of the offgas is withdrawn using an apparatus for manufacturing molten iron provided with a structure that is the same as that of the apparatus for manufacturing molten iron of FIG. 1. A withdrawn sensible heat of the offgas is used in the apparatus for generating energy provided with a structure that is the same as that of the apparatus for generating energy of FIG. 2. An amount of the energy used in the apparatus for manufacturing molten iron was 4945 Mcal/tHm per 1 ton of molten iron before the apparatus for generating energy was used.

Sensible heat of the offgas, which is obtained when molten iron is produced in the apparatus for manufacturing molten iron, was measured. The sensible heat was measured from an offgas discharged from the melter-gasifier, that from the fluidized-bed reduction reactor, and that from the compacted iron supply bin. Sensible heat of the offgas discharged from the melter-gasifier was 58 Mcal/tHm per ton of molten iron, and that from the fluidized-bed reduction reactor was 111 Mcal/tHm per ton of molten iron. In addition, sensible heat of the offgas discharged from the reduced iron supply bin was 22 Mcal/tHm per ton of molten iron.

The total amount of sensible heat of the above-described offgas was 291 Mcal/tHm per ton of molten iron. Electricity was produced by withdrawing the above total sensible heat from the apparatus for generating energy. As a result, the amount of the energy used in the apparatus for manufacturing molten iron was 4652 Mcal/tHm per ton of molten iron. Therefore, energy of 293 Mcal/tHm per ton of molten iron could be reduced by using the apparatus for generating energy. That is, an energy reduction of 6% occurred by using the apparatus for generating energy.

What is claimed is:

1. A method for generating energy, the method comprising:

providing an offgas discharged from an apparatus for manufacturing molten iron comprising a reduction reactor that provides reduced iron that is reduced from iron ore and a melter-gasifier that melts the reduced iron to manufacture molten iron;

converting cooling water into high pressure steam by contacting the cooling water with the offgas, wherein a temperature of the offgas after the offgas contacts the cooling water is in a range from 200° C. to 250° C.; and generating energy from at least one steam turbine by supplying the high pressure steam to the steam turbine and rotating the steam turbine.

2. The method of claim 1, wherein the cooling water indirectly contacts the offgas in the converting of the cooling water into high pressure steam.

3. The method of claim 1, wherein the pressure of the high pressure steam supplied to the steam turbine is equal to or greater than 40 bar.g in the generating of the energy.

4. The method of claim 1, further comprising:

providing low pressure steam that is discharged from the steam turbine that is rotated by the high pressure steam;

providing the cooling water by cooling the low pressure steam; and supplying the cooling water to the offgas, wherein the energy generated in the generating of the energy is used in the supplying of the cooling water to the offgas.

5. The method of claim 1 further comprising:

supplying processing water to the offgas that has contacted the cooling water;

collecting dust from the offgas by spraying water using the processing water; and withdrawing the processing water when it has finished collecting dust by spraying water, wherein energy generated in the generating of the energy is used in the supplying of the processing water to the offgas.

6. The method of claim 1, further comprising compressing the offgas that has contacted the cooling water, and wherein the energy generated in the generating of the energy is used in compressing the offgas.

7. The method of claim 1, further comprising:

providing low pressure steam that is discharged from the steam turbine that is rotated by the high pressure steam;

providing the cooling water by cooling the low pressure steam;

branching the cooling water;

heating the branched cooling water to convert it into surplus high pressure steam; and supplying the surplus high pressure steam to the steam turbine.

8. The method of claim 1 further comprising storing the high pressure steam.

9. An apparatus for generating energy, the apparatus comprising:

an apparatus for manufacturing molten iron that includes (a) a reduction reactor that produces reduced iron from iron ore and generates a first offgas, (b) a reduced iron storage bin that receives the reduced iron produced in the reduction reactor and that generates a second offgas, (c) a melter-gasifier that receives reduced iron from the reduced iron storage bin, melts the reduced iron to manufacture molten iron, and generates a third offgas, (d) a gas compressor that compresses a portion of the first offgas and that supplies the compressed first offgas to the melter-gasifier, and (e) a processing water circulation pump that pumps processing water to a first scrubber configured to scrub fine particles from the first offgas and a second scrubber configured to scrub fine particles from the second offgas;

a cooling water storage bin;

a first steam generator configured to (a) receive cooling water from the cooling water storage bin, (b) receive the first offgas from the reduction reactor, (c) convert the received cooling water into high pressure steam, and (d) reduce a temperature of the first offgas by between 150° C. and 250° C.;

a second steam generator configured to (a) receive cooling water from the cooling water storage bin, (b) receive the second offgas from the reduced iron storage bin, (c) convert the received cooling water into high pressure steam, and (d) reduce a temperature of the second offgas to between 500° C. and 600° C.;

a third steam generator configured to (a) receive cooling water from the cooling water storage bin, (b) receive the third offgas from the melter-gasifier, (c) convert the received cooling water into high pressure steam, and (d) reduce a temperature of the third offgas by between 100° C. and 250° C.;

a cooling water circulation pump configured to pump cooling water from the cooling water storage bin to the first, second and third steam generators; and a steam turbine configured to (a) receive high pressure steam from the first, second and third steam generators, and (b) supply energy to the cooling water circulation pump, the gas compressor, and the processing water circulation pump.

10. The apparatus of claim 9, wherein:

the first and second offgases are discharged after passing through the first and second steam generators, respectively; and the third offgas is supplied to the reduced iron storage bin after passing through the third steam generator.

11. The apparatus of claim 9, wherein the reduction reactor is a fluidized-bed reduction reactor.

12. The apparatus of claim 9, wherein the reduction reactor is a packed-bed reduction reactor.

13. The apparatus of claim 9, further comprising a condenser configured to cool low pressure steam discharged from the steam turbine and convert the low pressure steam into cooling water, the condenser being positioned between the steam turbine and the cooling water storage bin.

14. The apparatus of claim 9, wherein the apparatus for manufacturing molten iron further includes a processing water storage bin configured to (a) receive processing water from the first and second scrubbers, and (b) supply processing water to the processing water circulation pump.

* * * * *